US006135161A

United States Patent [19]

Nakano et al.

[11] Patent Number: 6,135,161

[45] Date of Patent: Oct. 24, 2000

[54] METHOD OF MAKING A FABRIC AND A FABRIC OBTAINED THEREFROM

[75] Inventors: Junichi Nakano, Kyoto; Tomomichi Fujiyama; Masao Seki, both of Shiga; Kiyokazu Minami, Fukui, all of Japan

[73] Assignee: Toray Industries, Inc., Japan

[21] Appl. No.: 09/334,880

[22] Filed: Jun. 17, 1999

[30] Foreign Application Priority Data

May 17, 1999 [JP] Japan ..... 11-135716

[51] Int. Cl.[7] ..... D03C 13/00

[52] U.S. Cl. ..... 139/55.1; 139/79; 139/31; 139/80; 139/81; 139/100

[58] Field of Search ..... 139/31, 32, 55.1, 139/79, 80, 81, 100, 108, 110, 54

[56] References Cited

U.S. PATENT DOCUMENTS 3,568,725 3/1971 Hindle ..... 139/76
3,703,195 11/1972 Schwarz ..... 139/71
3,964,523 6/1976 Benedict ..... 139/142
4,111,240 9/1978 Mallard ..... 139/449
4,727,910 3/1988 Surkamp ..... 139/76

*Primary Examiner*—John J. Calvert
*Assistant Examiner*—Robert H. Muromoto, Jr.
*Attorney, Agent, or Firm*—Austin R. Miller

[57] ABSTRACT

A method for producing a fabric, by a loom equipped with healds, a reed and a back roller, characterized by using synthetic filament yarns as the warp yarns and the weft yarns to be supplied to the loom, using a drive system having a cam for the shedding and closing motions of the healds, and keeping the dwell angle of the healds in a range from 85 to 120 degrees. The back roller is equipped with a positive easing mechanism, and the easing quantity by the easing mechanism is adjusted in a range from about 5 to about 15 mm. Where the warp yarns positioned in the selvages of the fabric among the warp yarns are called selvage yarns and the warp yarns additionally added to the selvage yarns are called insert yarns, then the number of insert yarns per 10 selvage yarns is in a range of from 1 to 10, and one selvage yarn each and one insert yarn each are guided through each dent of the reed.

18 Claims, No Drawings

METHOD OF MAKING A FABRIC AND A FABRIC OBTAINED THEREFROM

BACKGROUND OF THE INVENTION

1. Field of the Invention

The present invention relates to a method for making a fabric comprising fibers woven in a high density and to a fabric obtained therefrom. A fabric with fibers woven in a high density is called a high density fabric. A high density fabric is used, for example, as a base cloth for an uncoated air bags installed in motor vehicles. The high density fabric used as the base cloth of uncoated air bags is required to have a low air permeability.

The present invention provides an efficient production method of a fabric having a high density and a low air permeability, by improving the conventional weaving method of fabric.

2. Description of the Prior Arts

It is desired to develop air bags which can assure higher safety of passengers of motor vehicles. A sensor detects an impact of a car collision and immediately after the detection, a high temperature high pressure gas is produced in an air bag, and the air bag is instantaneously inflated by the gas. Therefore, the woven fabric forming the air bag is required to have a high density and a uniform low air permeability.

Air bags are classified into coated air bags formed with a base cloth coated on its surface with an urethane or silicone resin, etc., and uncoated air bags formed with a base cloth having no coating on its surface.

Uncoated base cloths and uncoated air bags made therefrom are disclosed in Japanese Patent Laid-Open (Kokai) Nos. Hei 4-2835 and Hei 6-146132 and U.S. Pat. Nos. 4,977,016 and 5,073,418.

The uncoated base cloths for air bags are woven by a water jet loom (hereinafter abbreviated as WJL) with the shedding motion of the healds performed by a crank mechanism or a rapier loom. However, the base cloths obtained by them cannot be said to be high density fabrics having a desired uniform low air permeability.

Where the shedding of the healds is carried out by a crank mechanism, the shedding time of the healds is short. Therefore, at the time of picking motion, weft yarns are less likely to be flown sufficiently and stably. Therefore, the water jet flow collides with the warp yarns and fluffs are generated on the warp yarns. As a result, the weaving quality is remarkably degraded.

To solve the problem, it can be considered to raise the water jet pressure. However, if the water jet pressure is raised, it causes a high tension acting on the weft yarns and excessive weave contraction which bring down difficulty in weaving. This method does not improve quality of weaving.

It can also be considered to weave at a higher warp tension. However, if the warp tension is higher, friction of warp yarns with the reed and the healds increases at the time of beating motion and shredding motion and it causes problems of warp breakage and warp fluffing. This method does not improve quality of weaving.

As another problem, a fabric having a higher density has larger weave contraction in the weft direction immediately after completion of weaving. Because of large weave contraction, the difference between the denting width and the weave width becomes large, and a phenomenon that the warp yarns beside the selvages are strongly scrubbed by the reed is observed. This phenomenon causes warp fluffing and warp breakage, and must be eliminated to obtain a desired high density fabric.

SUMMARY OF THE INVENTION

The present invention solves the above mentioned problems of the prior arts.

A first object of the present invention is to provide a method for producing a fabric having a low air permeability. A second object is to provide a method for producing a fabric having excellent weaving efficiency or excellent productivity. A third object is to provide a fabric having excellent tensile strength, rip strength and breaking elongation and low air permeability. The fabric having a low air permeability can be preferably used as the base cloth for uncoated air bags.

The method for producing a fabric of the present invention comprises using a loom having a warp supply mechanism, weft supply mechanism, weaving mechanism and fabric take-up mechanism wherein a shedding motion of a heald in the weaving mechanism is performed by a driving mechanism having a cam and a dwell angle of the shedding motion is selected in a range from 85 degrees to 120 degrees, and further comprises the steps of supplying a desired number of inlaid synthetic filament yarns as warp yarns from the warp supplying mechanism to the weaving mechanism, picking synthetic filament yarns as weft yarns from the weft supply mechanism in response to the shedding motion, weaving the warp yarns and the weft yarns, and taking up a woven fabric by the fabric take-up mechanism.

It is preferable that the dwell angle is in a range from 90 degrees to 115 degrees. A more preferable is in a range from 95 degrees to 110 degrees.

It is preferable that a back roller of the loom is equipped with a positive easing mechanism. It is preferable that an easing quantity of the easing mechanism is selected in a range from about 5 mm to about 15 mm. A more preferable is in a range from about 7 mm to about 13 mm.

Among the warp yarns, those located at the selvages of a fabric are called selvage yarns, and the warp yarns further added to the selvage yarns are called insert yarns. It is preferable that the number of insert yarns per 10 selvage yarns is in a range from 1 to 10, and that one selvage yarn and one insert yarn are guided through each dent of the reed.

It is preferable that the synthetic filament yarns are synthetic polyarnide or polyester filament yarns.

It is preferable that the width of the woven fabric is not less than about 150 cm.

It is preferable that the loom is a water jet loom, air jet loom or rapier loom.

Where a water jet loom or air jet loom is used, it is preferable that the rotating speed of the crankshaft to drive the reed of the loom is not less than about 400 rpm. Where a rapier loom is used, it is preferable that the rotating speed of the crankshaft to drive the reed of the loom is not less than about 100 rpm.

It is preferable that the weaving conditions are selected to weave a fabric having an air permeability of not more than about 1.0 $cc/cm^2/sec$. The air permeability is measured according to the 6.27.1A method in JIS L 1096.

It is preferable that the warp yarns and the weft yarns are of in a range from about 100 to about 1,000 deniers per yarn respectively, and that the weaving conditions are selected to achieve a total cover factor CF of the woven fabric of not less than about 2,100.

It is preferable that the weaving conditions are selected to keep a ratio CF2/CF1 of a weft cover factor to a warp cover factor in a range from 0.9 to 1.

The total cover factor CF is defined by the following formula:

$$CF=CF1+CF2$$

where CF1 is a cover factor of the fabric in the warp direction and CF2 is a cover factor of the fabric in the weft direction. CF1 and CF2 are defined respectively as follows:

*CF*1=Square of deniers of warp×Weave density of warp (yarns/inch)

*CF*2=Square of deniers of weft×Weave density of weft (yarns/inch)

DESCRIPTION OF THE PREFERRED EMBODIMENTS

Preferable embodiments of the fabric of the present invention and the production method thereof are described below.

It is preferable that the synthetic fibers constituting the fabric of the present invention are polyarnide filament yarns made of nylon 6, nylon 66 or their copolymer or polyester filament yarns.

The filament yarns can contain various additives usually used for improving the productivity in production and processing and properties. The additives include a thermostabilizer, antioxidant, photostabilizer, smoothing agent, antistatic agent, plasticizer, thickener, pigment, flame retarder, etc.

It is preferable that the multifilament yarns are of in a range from about 100 to about 1,000 deniers. It is also preferable that the single filament yarns are of in a range from about 1 denier to about 7 deniers, and that the single yarn strength is not less than about 7 g/denier.

In the use of the fabric as a base cloth for air bags, the fabric becomes excellent in the strength and snug setting (compactness) required as the base cloth for air bags where the deniers of the multifilament yarns are in the above range.

If the yarn deniers are lower than the lower limit of the above range, the strength as a base cloth for air bags is insufficient, and if the yarn deniers are higher than the upper limit of the above range, the base cloth is highly thick and highly voluminous, to degrade the snug setting.

Such filament yarns are used as both warp yarns and weft yarns in the production of the fabric.

It is preferable that a textile design is a plain weave which is suitable for obtaining a fabric having the lowest thickness. Since it is good in the snug setting when used as a base cloth for air bags. As derivative weaves of the plain weave, rip and 2/2 mat can also be used.

It is possible to weave a plain weave fabric different in density between warp and weft, but considering productivity and the performance as a base cloth for uncoated air bags, it is preferable that a fabric has a ratio CF2/CF1 of the cover factor in weft direction to that in warp direction of not less than 0.9 and not more than 1. If the ratio CF2/CF1 is less than 0.9, it is difficult to produce a high weave density fabric having a low air permeability according to the present invention.

The method for producing a fabric according to the present invention will be explained below in the order of steps.

I. Beam warping process

At first, filament yarns are set up on a warp creel for beaming. Then, a beam having as many warp yarns as required for the intended woven fabric is formed by the beaming. The warping process itself is conventionally known. To prevent a warp fluffing during weaving and to improve a shedding motion, an oiling agent may apply to the warp yarns.

The oiling agent which may be preferably used is a paste or liquid comprising one or mixture of hydrocarbons, fatty acid esters, liquid paraffin, etc. dispersed in a nonionic or cationic surfactant.

In the warping process, insert yarns added to selvage yarns are also simultaneously beamed. It is preferable that insert yarn(s) of not more than 10 are used for 10 warp yarns at each of the selvages of the fabric to be formed, and that one selvage yarn each and one insert yarn each are guided through each dent.

It is preferable that the insert yarns are the same synthetic filament yarns as used as the ground yarns. It is preferable that the insert multifilament yarns are in a range from about 50 deniers to about 200 deniers. It is preferable that the insert yarns at the selvages are thinner than the ground warp yarns.

If the insert multifilament yarns are of less than about 50 deniers, it is difficult to prevent the warp breakage and warp fluffing caused by the scrubbing of warp yarns by the reed beside the selvages. If more than about 200 deniers, the selvages become so highly thick as to be wound poorly in the later winding process, causing wrinkles.

II. Drawing process

The warp beam prepared like this is installed in a loom and the warp yarns are guided through the healds and reed in the drawing process. The number of healds and the number of warp yarns guided through each dent of the reed are not especially limited. For the insert yarns added to the selvage yarns in the present invention, a pair of one warp yarn and one insert yarn are guided through each heald eye and each reed dent. For the reed, one set consisting of two warp yarns and two insert yarns may be guided through each dent.

III. Weaving process

The prepared warp yarns are woven with separately arranged weft yarns by the loom with healds driven by a cam. The loom can be any of water jet loom, air jet loom or rapier loom, etc. as described before.

However, the dwell angle of healds must be set at in a range from 85 degrees to 120 degrees. The dwell angle decides the dwell time of the healds when the healds are kept at the maximum shedding position. This adjustment is accomplished by selecting any of the cams with various dwell angles and keeping it engaged with or disengaged from the crankshaft drive system.

If the dwell angle is set at in a range from 85 degrees to 120 degrees, preferably from 90 degrees to 115 degrees, more preferably from 95 degrees to 110 degrees in the loom, the shedding, picking and beating as the three major motions of weaving are well balanced in timing in the shedding and closing motions of healds at the time of weaving. This sufficiently assures the time taken for flying of weft yarns, to allow a stable picking motion. As a result, efficient weaving can be continued at a high speed.

It is preferable that the loom has a positive easing mechanism installed at the back roller. The easing quantity by the positive easing mechanism is defined by the distance between the back roller position at the time of maximum shedding (the front position) and the back roller position at the time of complete shed closing (the back position).

In the weaving of a high density fabric used as a base cloth for uncoated air bags, usually the weaving conditions are set to keep the warp tension high. However, in this case, since excessive tension acts on the warp yarns every shedding motion of healds, weaving may not be continued because of warp breakage and warp fluffing.

This problem can be solved by positive easing. It is preferable that the easing quantity is set in a range from about 5 mm to about 15 mm. A more preferable range is from about 7 mm to about 13 mm.

If easing is set like this, the excessive tension acting on the warp yarns at every shedding motion of healds can be prevented. Furthermore, since the warp yarns are tensioned at the time of shed closing, i.e., at the moment of beating, sufficient weft inserting can be performed, to allow easier production of a high weave density fabric having a low air permeability.

The easing quantity is also adjusted by adjusting the back roller drive system interlocked with said crankshaft.

If a jet loom is used, it is preferable that the rotating speed of the crankshaft for moving the reed is not less than about 400 rpm. When a rapier loom is used, it is preferable that the rotating speed is not less than about 100 rpm.

It is preferable that the weave width is not less than about 150 cm.

The fabric woven under the above mentioned looms and weaving conditions thereon may be finished by applying methods usually used for scouring and heat setting ordinary woven synthetic filament fabrics. However, the cloth neither washed nor set may also be used as a base cloth for air bags.

IV. Scouring process

Scouring is used mainly for removing the yarn oils and other oils deposited on the cloth, which may adversely affect the flame retardancy of the product.

For scouring, the woven fabric is immersed in a scouring bowl containing a scouring agent such as sodium alkylbenzenesulfonate, and the scouring agent, etc. deposited on the woven fabric are removed by a mangle, etc. Then, the woven fabric is washed by water and dried.

It is preferable that the temperature of the scouring bowl is in a range from about 50° C. to about 98° C. If the temperature is too low, it is difficult to efficiently remove the yarn oils and other oils. It is preferable that the drying after scouring is carried out at a temperature of from about 100° C. to about 130° C.

V. Heat setting process

Heat setting is performed for keeping the woven width of the fabric in a certain range and keeping the dry heat shrinkage percentage small by heating to prevent dimensional change of the fabric in the ambient temperature atmosphere.

For heat setting, usually a stenter, etc. is used, and the heated woven fabric is contracted or elongated in the transverse direction or longitudinal direction, to achieve the intended product width.

It is preferable that the set width is kept in a range from about −5% to about +5% of the washed and dried woven width.

If the set width is too narrow, the woven fabric is contracted and its thickness is increased. Therefore, a very narrow set width is unpreferable. Furthermore, if the set width is too narrow, the crimp rate in the weft direction becomes large and the air permeability is increased. Therefore, a very narrow set width is unpreferable.

On the contrary, if the set width is too wide, machines such as a stenter are overloaded and it causes machine troubles, and the chinks are formed in the woven fabric and it increases the air permeability. Therefore, a very wide set width is unpreferable.

It is preferable that the overfeed rate in the heat setting process is kept in a range from about −10% to about +10%.

If the overfeed rate is too large, the woven fabric is contracted to increase its thickness. Therefore, a very large overfeed rate is unpreferable. Furthermore, if the overfeed rate is too large, the crimp rate of warp yarns becomes large to increase the air permeability. Therefore, a very large overfeed rate is unpreferable.

On the contrary, if the overfeed rate is too small, since the woven fabric is pulled when it is fed into machines such as a stenter, the machines are overloaded and it causes machine troubles, and chinks are formed in the woven fabric and it increases the air permeability. Therefore, a very small overload rate is unpreferable.

It is preferable that the setting temperature is in a range from about 130° C. to about 200° C.

If the setting temperature is lower than about 130° C., the woven fabric cannot be usually contracted or elongated to the set width.

If the setting temperature is higher than about 200° C., the yarns are deteriorated and it lowers the strength of the woven fabric. Furthermore, the yarns are contracted greatly and it forms chinks in the woven fabric and further it increases the air permeability. Therefore, a setting temperature higher than about 200° C. is unpreferable.

The fabric produced according to the present invention can be used as a base cloth for air bags, and the air bags produced by using the fabric can be used as an air bag for the driver's seat, an air bag for the assistant driver's seat, air bags for the rear seats, air bags for lateral sides, etc.

A feature of the method for producing the fabric of the present invention is that yarn breakage and fluffing in the weaving process can be substantially prevented. As a result, the obtained fabric shows a high weave density, a low air permeability and excellent compactness. So, the fabric is preferable as a base cloth for uncoated air bags.

EXAMPLES

The respective properties shown in the following examples were obtained according to the following definitions and measuring methods.

Air permeability: Obtained according to the method specified in JIS L 1096 (6.27.1A method).

Strength: Obtained according to the method specified in JIS L 1096 (6.12.1A method). The breaking strength of a 3 cm wide woven fabric at a clamp distance of 15 cm at a tensile speed of 200 mm/min was measured.

Elongation: Obtained according to the method specified in JIS L 1096 (6.12.1A method). The breaking elongation of a 3 cm wide woven fabric at a clamp distance of 15 cm at a tensile speed of 200 mm/min was measured.

Rip strength: Obtained according to the method specified in JIS L 1096 (6.15.2A-2 method). The rip strength at a tensile speed of 200 mm/min was measured.

General evaluation: The symbols "◎", "○", "Δ", "×" and "−" in the general evaluation in Table 1 mean the following respectively:

"◎": Very excellent in quality, performance and productivity.

"○": Excellent in quality, performance and productivity.

"Δ": Rather poor in quality, performance and productivity.

"×": Poor in quality, performance and productivity.

"−": Weaving impossible

Example 1

The warp yarns and weft yarns used were 420-denier high strength nylon 66 filament yarns. Warp yarns were guided into a warper and a beamer, to form a beam with 3,303 warp yarns. The four warp yarns per selvage of the beam (eight yarns at both the selvages) were 110-denier nylon 6 insert yarns. The insert yarns were simultaneously beamed in said beaming.

The loom used was ZW405 cam type WJL (water jet loom) produced by Tsudakoma Corp.

In the loom, for four healds, one warp yarn each for the ground was guided through each eye, and one warp yarn each and one insert yarn each, i.e., two yarns each for the selvages were guided through each eye. A 2.8 mm thick steel reed with 51 dents per inch was used, and one warp yarn each for the ground was guided through each dent, while two warp yarns each for the selvages were guided through each dent. The denting width was 164.3 cm.

The weaving conditions of the loom were as follows:

Dwell angle: 90 degrees

Reed stroke: 93 mm

Shedding timing: 350 degrees

Easing:
- Type: Positive easing
- Easing quantity: 10 mm
- Easing timing: 345 degrees Shedding height:
- First heald: 54 mm
- Fourth heald: 64 mm Warp tension: 185 g/yarn Rotating speed of loom: 600 rpm Weave density: 54×54 yarns/inch Textile design: Plain weave The obtained woven fabric was immersed in an 80° C. water bath containing 0.5 g/l of sodium alkylbenzenesulfonate and 0.5 g/l of soda ash (scouring process). Then, the woven fabric was dried at 130° C. The dried woven fabric was set by a pin stenter at a set width of 154 cm, overfeed rate of 2% and temperature of 180° C. (heat setting process). The woven fabric obtained was used as a base cloth for uncoated air bags.

Properties of base cloth:

Set up density: 55×55 yarns/inch

Total cover factor CF: 2,254

Ratio CF2/CF1 of weft cover factor to warp cover factor: 1.0

Air permeability (woven width: 154 cm): 0.3 cc/cm$^2$/sec

In the weaving and processing, no problem occurred at all.

The woven fabric was a high weave density fabric having a low permeability, and suitable as a base cloth for uncoated air bags. The properties of the woven fabric are shown in Table 1.

Example 2

The warp yarns and weft yarns used were 630-denier ordinary nylon 6 filament yarns. Warp yarns were guided into a warper and a beamer, to form a beam with 2,432 warp yarns. The beam did not have the insert yarns for the selvages.

The loom used was ZW405 cam type WJL produced by Tsudakoma Corp.

In the loom, for four healds, one warp yarn each was guided through each eye. A 3 mm thick steel reed with 19 dents per inch was used, and two warp yarns each were guided through each dent. The denting width was 162.6 cm.

The weaving conditions of the loom were as follows:

Dwell angle: 95 degrees

Reed stroke: 93 mm

Shedding timing: 350 degrees

Easing:
- Type: Positive easing
- Easing quantity: 6 mm
- Easing timing: 345 degrees Shedding height:
- First heald: 54 mm
- Fourth heald: 64 mm Warp tension: 220 g/yarn Rotating speed of loom: 450 rpm Weave density: 41.5×41.5 yarns/inch Textile design: Plain weave The obtained woven fabric was immersed in a 70° C. water bath containing 0.5 g/l of sodium alkylbenzenesulfonate and 0.5 g/l of soda ash. Then, the woven fabric was dried at 120° C. The dried woven fabric was set by a pin stenter at a set width of 154.5 cm, overfeed rate of 1% and temperature of 170° C. The woven fabric obtained was used as a base cloth for uncoated air bags.

Properties of base cloth:

Set up density: 42×42 yarns/inch

Total cover factor CF: 2,108

Ratio CF2/CF1 of weft cover factor to warp cover factor: 1.0

Air permeability (woven width: 154.5 cm): 0.6 cc/cm$^2$/sec

In the weaving and processing, no problem occurred at all.

The woven fabric was a high weave density fabric with a low permeability, and suitable as a base cloth for uncoated air bags, like the woven fabric obtained in Example 1. The properties of the woven fabric are shown in Table 1.

Examples 3 and 4

The warp yarns and weft yarns used were 210-denier high strength nylon 66 filament yarns. Warp yarns were guided into a warper and a beamer, to form a beam with 4,678 warp yarns. The four warp yarns per selvage of the beam (eight yarns at both the selvages) were 70-denier nylon 6 insert yarns. The insert yarns were simultaneously beamed in said beaming.

The loom used was ZW305 cam type WJL produced by Tsudakoma Corp.

In the loom, for four healds, one warp yarn each for the ground was guided through each eye, and one warp yarn each and one insert yarn each, i.e., two yarns each for the selvages were guided through each eye. A 2.8 mm thick steel reed with 38 dents per inch was used, and two warp yarns each for the ground were guided through each dent, while three warp yarns each for the selvages were guided through each dent. The denting width was 156 cm.

The weaving conditions of the loom were as follows:

Dwell angle: 90 degrees

Reed stroke: 93 mm

Shedding timing: 350 degrees

Easing:
- Type: Positive easing
- Easing quantity: 10 mm
- Easing timing: 345 degrees Shedding height:
- First heald: 54 mm Fourth heald: 64 mm Warp tension: 85 g/yarn Rotating speed of loom: 550 rpm Weave density: 76×76 yarns/inch Textile design: Plain weave In Example 3, the obtained woven fabric was immersed in a 60° C. water bath containing 0.5 g/l of sodium alkylbenzenesulfonate and 0.5 g/l of soda ash. Then, the woven fabric was dried at 130° C. The dried woven fabric was set by a pin stenter at a set width of 155 cm, overfeed rate of 0% and temperature of 180° C. The woven fabric obtained was used as a base cloth for uncoated air bags.

In Example 4, the obtained woven fabric was used as a base cloth for uncoated air bags as it was, without being washed and set. Properties of base cloth (Examples 3 and 4):

Set up density: 76×76 yarns/inch

Total cover factor CF: 2,202

Ratio CF2/CF1 of weft cover factor to warp cover factor: 1.0

Air permeability (woven width: 155 cm): 0.1 cc/cm$^2$/sec

In the weaving and processing, no problem occurred at all.

The woven fabric was a high weave density fabric with a low permeability, and suitable as a base cloth for uncoated air bags. The properties of the woven fabric are shown in Table 1.

Example 5

The warp yarns and weft yarns used were 420-denier high strength nylon 66 filament yarns. Warp yarns were guided into a warper and a beamer, to form a beam with 3,622 warp yarns. The six warp yarns per selvage of the beam (twelve yarns at both the selvages) were 110-denier nylon 6 insert yarns. The insert yarns were simultaneously beamed in said beaming.

The loom used was ZAX denim use cam type AJL (air jet loom) produced by Tsudakoma Corp.

In the loom, for four healds, one warp yarn each for the ground was guided through each eye, and one warp yarn each and one insert yarn each, i.e., two yarns each for the selvages were guided through each eye. A 2.8 mm thick steel reed with 56 dents per inch was used, and one warp yarn each for the ground was guided through each dent, while two warp yarns each for the selvages were guided through each dent. The denting width was 164.3 cm.

The weaving conditions of the loom were as follows:

Dwell angle: 120 degrees

Reed stroke: 80 mm

Shedding timing: 345 degrees

Easing:

- Type: Positive easing
- Easing quantity: 15 mm
- Easing timing: 345 degrees

Shedding height:

- First heald: 50 mm
- Fourth heald: 60 mm

Air pressure (for both main and sub): 5 kg/cm

Warp tension: 170 g/yarn

Rotating speed of loom: 550 rpm

Weave density: 59.5×60 yarns/inch

Textile design: Plain weave

The obtained woven fabric was immersed in a 95° C. water bath containing 0.5 g/l of sodium alkylbenzenesulfonate and 0.5 g/l of soda ash. Then, the woven fabric was dried at 120° C. The dried woven fabric was set by a pin stenter at a set width of 154 cm, overfeed rate of 1% and temperature of 180° C. The woven fabric obtained was used as a base cloth for uncoated air bags.

Properties of base cloth:

Set up density: 60×60 yarns/inch

Total cover factor CF: 2,459

Ratio CF2/CF1 of weft cover factor to warp cover factor: 1.0

Air permeability (woven width: 154 cm): 0.3 cc/cm$^2$/sec

In the weaving and processing, no problem occurred at all.

The woven fabric was a high weave density fabric with a low permeability, and suitable as a base cloth for uncoated air bags. It was found that a high weave density fabric can be produced also by a cam type AJL. The properties of the woven fabric are shown in Table 1.

Example 6

The warp yarns and weft yarns used were 420-denier high strength nylon 66 filament yarns. Warp yarns were guided into a warper and a beamer, to form a beam with 3,351 warp yarns. The six warp yarns per selvage of the beam (twelve yarns at both the selvages) were 110-denier nylon 6 insert yarns. The insert yarns were simultaneously beamed in said beaming.

The loom used was a rapier cam type loom produced by K. K. Kubo Tekkosho.

In the loom, for four healds, one warp yarn each for the ground was guided through each eye, and one warp yarn each and one insert yarn each, i.e., two yarns each for the selvages were guided through each eye. A 2.8 mm thick steel reed with 13.3 dents per inch was used, and four warp yarns each for the ground were guided through each dent, while five warp yarns each for the selvages were guided through each dent. The denting width was 160 cm.

The weaving conditions of the loom were as follows:

Dwell angle: 100 degrees

Reed stroke: 80 mm

Shedding timing: 350 degrees

Easing:

- Type: Positive easing
- Easing quantity: 10 mm
- Easing timing: 345 degrees

Shedding height:

- First heald: 50 mm
- Fourth heald: 60 mm

Warp tension: 350 g/yarn

Rotating speed of loom: 100 rpm

Weave density: 58×58 yarns/inch

Textile design: Plain weave

The obtained woven fabric was immersed in a 95° C. water bath containing 0.5 g/l of sodium alkylbenzenesulfonate and 0.5 g/l of soda ash. Then, the woven fabric was dried at 130° C. The dried woven fabric was set by a pin stenter at a set width of 157 cm, overfeed rate of 4% and temperature of 190° C. The woven fabric obtained was used as a base cloth for uncoated air bags.

Properties of base cloth:

Set up density: 60×60 yarns/inch

Total cover factor CF: 2,459

Ratio CF2/CF1 of weft cover factor to warp cover factor: 1.0

Air permeability (woven width: 157 cm): 0.1 cc/cm$^2$/sec

In the weaving and processing, no problem occurred at all.

The woven fabric was a high weave density fabric with a low permeability, and suitable as a base cloth for uncoated air bags. It was found that a high weave density fabric can also be produced by a rapier cam type loom. The properties of the woven fabric are shown in Table 1.

Example 7

The warp yarns and weft yarns used were 315-denier high strength nylon 66 filament yarns. Warp yarns were guided into a warper and a beamer, to form a beam with 3,800 warp yarns. The four warp yarns per selvage of the beam (eight yarns at both the selvages) were 70-denier nylon 6 insert yarns. The insert yarns were simultaneously beamed in said beaming.

The loom used was ZW405 cam type WJL produced by Tsudakoma Corp.

In the loom, for four healds, one warp yarn each for the ground was guided through each eye, and one warp yarn each and one insert yarn each, i.e., two yarns each for the selvages were guided through each eye. A 2.8 mm thick steel reed with 30.0 dents per inch was used, and two warp yarns each for the ground were guided through each dent, while two yarns each for the selvages were guided through each dent. The denting width was 160.9 cm.

The weaving conditions of the loom were as follows:

Dwell angle: 95 degrees

Reed stroke: 93 mm

Shedding timing: 350 degrees

Easing:

Type: Positive easing

Easing quantity: 12 mm

Easing timing: 345 degrees

Shedding height:

First heald: 54 mm

Fourth heald: 64 mm

Warp tension: 165 g/yarn

Rotating speed of loom: 600 rpm

Weave density: 62×62 yarns/inch

Textile design: Plain weave

The obtained woven fabric was immersed in a 70° C. water bath containing 0.5 g/l of sodium alkylbenzenesulfonate and 0.5 g/l of soda ash. Then, the woven fabric was dried at 120° C. The dried woven fabric was set by a pin stenter at a set width of 154 cm, overfeed rate of 2% and temperature of 180° C. The woven fabric obtained was used as a base cloth for uncoated air bags.

Properties of base cloth:

Set up density: 63×63 yarns/inch

Total cover factor CF: 2,236

Ratio CF2/CF1 of weft cover factor to warp cover factor: 1.0

Air permeability (woven width: 154 cm): 0.2 cc/cm$^2$/sec

In the weaving and processing, no problem occurred at all.

The woven fabric was a high weave density fabric with a low permeability, and suitable as a base cloth for uncoated air bags. The properties of the woven fabric are shown in Table 1.

Comparative Example 1

The warp yarns and weft yarns used were 420-denier high strength nylon 66 filament yarns. Warp yarns were guided into a warper and a beamer, to form a beam with 3,303 warp yarns. The four warp yarns per selvage of the beam (eight yarns at both the selvages) were 110-denier nylon 6 insert yarns. The insert yarns were simultaneously beamed in said beaming. The beam composition and weft composition obtained here are the same as those of Example 1.

The loom used was ZW305 cam type WJL produced by Tsudakoma Corp.

In the loom, for four healds, one warp yarn each for the ground was guided through each eye, and one warp yarn each and one insert yarn each, i.e., two yarns each for the selvages were guided through each eye. A 4 mm thick steel reed with 51 dents per inch was used, and one warp yarn each for the ground was guided through each dent, while two warp yarns each for the selvages were guided through each dent. The denting width was 164.3 cm.

The weaving conditions of the loom were as follows:

Reed stroke: 84 mm

Shedding timing: 345 degrees

Easing: Type: Negative easing

Shedding height:

First heald: 54 mm

Fourth heald: 64 mm

Warp tension: 185 g/yarn

Rotating speed of loom: 600 rpm

Intended weave density: 54×54 yarns/inch

Textile design: Plain weave

In the loom, weaving was attempted to achieve a weave density of 54×54 yarns/inch as in Example 1. However, it was found that a fabric with this weave density could not be woven. The density of the warp and weft yarns was gradually lowered for attempting weaving.

As a result, it was found that a weave density of 51×51 yarns/inch was the limit of the fabric capable of being woven by this crank type negative easing loom.

Similar examination was performed using WJL LW54 and LW50 crank type easing looms produced by Nissan Motor Co., Ltd. However, the results were the same.

The obtained woven fabric was 2,090 in total cover factor CF, 1.0 in the ratio CF2/CF1 of weft cover factor to warp cover factor, and more than 1.0 cc/cm$^2$/sec in air permeability.

The woven fabric was not satisfactory as a base cloth for uncoated air bags. The properties of the woven fabric are shown in Table 1.

Comparative Example 2

The warp yarns and weft yarns used were 420-denier high strength nylon 66 filament yarns. Warp yarns were guided into a warper and a beamer, to form a beam with 3,303 warp yarns. The four warp yarns per selvage of the beam (eight yarns at both the selvages) were 110-denier nylon 6 insert yarns. The insert yarns were simultaneously beamed in said beaming. The beam composition and weft composition obtained here are the same as those of Example 1.

The loom used was ZW405 cam type WJL produced by Tsudakoma Corp.

In the loom, for four healds, one warp yarn each for the ground was guided through each eye, and one warp yarn each and one insert yarn each, i.e., two yarns each for the selvages were guided through each eye. A 2.8 mm thick steel reed with 51 dents per inch was used, and one warp yarn each for the ground was guided through each dent, and two warp yarns each for the selvages were guided through each dent. The denting width was 164.3 cm.

The weaving conditions of the loom were as follows:

Dwell angle: 45 degrees

Reed stroke: 93 mm

Shedding timing: 350 degrees

Easing:

Type: Positive easing

Easing quantity: 10 mm

Easing timing: 345 degrees

Shedding height:

First heald: 54 mm

Fourth heald: 64 mm

Warp tension: 185 g/yarn

Rotating speed of loom: 600 rpm

Weave density: 54×54 yarns/inch

Textile design: Plain weave

Weaving was started, but because of a low dwell angle and a short shedding time, picking could not be effected. Weaving could not be effected as in the case of the crank type loom in Comparative Example 1.

Comparative Example 3

Weaving was attempted to be effected as described for Comparative Example 2, except that the dwell angle was 130 degrees.

Though the shedding time in weaving was long, picking could not be effected since the balance in the entire weaving conditions was lost. Weaving could not be effected as in the case of the crank type loom in Comparative Example 1.

The results of the above examples and comparative examples are listed in Table 1.

The fabric with a low air permeability with good quality as intended in the present invention can be achieved by using synthetic filament yarns of 100 to 1,000 deniers and by having a total cover factor of 2,100 or more. The method for producing the fabric with good quality weave (productivity) intended in the present invention can be achieved by using a loom having a cam for the shedding motion and with the dwell angle set in a range from 85 to 120 degrees. This eliminates the problems of yarn breaking and fluffing during weaving and allows the production of a fabric with a low air permeability at low cost. The fabric is suitable as a base cloth for uncoated air bags.

TABLE 1

| | Weaving conditions | | | | | |
|---|---|---|---|---|---|---|
| | Material | Deniers | Weave density (yarns/in) | Cover factor | Loom used | Dwell angle (degrees) |
| Example 1 | N66 | 420 | 54/54 | 2254 | Cam type WJL | 90 |
| Example 2 | N66 | 630 | 41.5/41.5 | 2108 | Cam type WJL | 95 |
| Example 3 | N66 | 210 | 76/76 | 2202 | Cam type WJL | 90 |
| Example 4 | N66 | 210 | 76/76 | 2202 | Cam type WJL | 90 |
| Example 5 | N66 | 420 | 59.5/60 | 2459 | Air jet | 120 |
| Example 6 | N66 | 420 | 58/58 | 2459 | Rapier | 100 |
| Example 7 | N66 | 315 | 62/62 | 2236 | Cam type WJL | 95 |
| Comparative Example 1 | N66 | 420 | 51/51 | 2090 | Crank type WJL | 0 |

TABLE 1-continued

| | Weaving conditions | | | | | |
|---|---|---|---|---|---|---|
| | Material | Deniers | Weave density (yarns/in) | Cover factor | Loom used | Dwell angle (degrees) |
| Comparative Example 2 | N66 | 420 | — | — | Cam type WJL | 70 |
| Comparative Example 3 | N66 | 420 | — | — | Cam type WJL | 130 |

| | Air permeability (cc/cm²/sec) | Quality weave (productivity) | Strength (N/cm) | Elongation (%) | Rip strength (N) | General evaluation |
|---|---|---|---|---|---|---|
| Example 1 | 0.3 | ○ | 701/748 | 30/23 | 178/208 | ◎ |
| Example 2 | 0.6 | ◎ | 803/855 | 31/23 | 242/280 | ◎ |
| Example 3 | 0.1 | ○ | 480/511 | 29/22 | 91/105 | ○ |
| Example 4 | 0.1 | ○ | 489/520 | 29/22 | 94/106 | ○ |
| Example 5 | 0.3 | ○ | 760/811 | 30/22 | 170/198 | ◎ |
| Example 6 | 0.1 | ◎ | 766/814 | 30/22 | 172/201 | ◎ |
| Example 7 | 0.2 | ◎ | 610/645 | 30/23 | 156/175 | ○ |
| Comparative Example 1 | 1.1 | Δ | 654/699 | 25/21 | 191/221 | Δ |
| Comparative Example 2 | — | x | — | — | — | — |
| Comparative Example 3 | — | x | — | — | — | — |

What is claimed is:

1. A method of making a fabric using a loom equipped with a heald, a reed and a back roller, comprising the steps of supplying warp yarns and weft yarns comprising synthetic filament yarns respectively to the loom and performing shedding and closing motions of the heald by a drive system having a cam, and selecting a dwell angle of the heald in a range from 85 to 120 degrees.

2. A method of making a fabric according to claim 1 further comprising selecting the dwell angle in a range from 90 to 115 degrees.

3. A method of making a fabric according to claim 2 further comprising selecting the dwell angle in a range from 95 to 110 degrees.

4. A method of making a fabric according to claim 1, further comprising the step of equipping the back roller with a positive easing mechanism, and establishing the easing quantity by the easing mechanism in a range from about 5 to about 15 mm.

5. A method of making a fabric according to claim 4 further comprising selecting, the easing quantity in a range from about 7 to about 13 mm.

6. A method of making a fabric according to claim 1 or 4, wherein the warp yarns positioned in the selvages of the fabric among the warp yarns are called selvage yarns and the warp yarns additionally added to the selvage warp yarns are called insert yarns, the number of insert yarns per 10 selvage yarns is in a range of 1 to 10, further comprising the step of guiding one selvage yarn each and one insert yarn each are through each dent of the reed.

7. A method of making a fabric according to claim 1 further comprising providing, the synthetic filament yarns as synthetic polyarnide filament yarns.

8. A method of making a fabric according to claim 1, wherein the synthetic filament yarns are synthetic polyester filament yarns.

9. A method of making a fabric according to claim 1 further comprising providing the width of the woven fabric as not less than about 150 cm.

10. A method of making a fabric according to claim 1, further comprising weaving on a water jet loom.

11. A method of making a fabric according to claim 1, wherein the loom is an air jet loom.

12. A method of making a fabric according to claim 10 or 11, further comprising rotating speed of the crankshaft for driving the reed of the loom at not less than about 400 rpm.

13. A method of making a fabric according to claim 1, wherein the loom is a rapier loom.

14. A method of making a fabric according to claim 13, wherein rotating speed of a crankshaft for driving the reed of the loom is not less than about 100 rpm.

15. A method of making a fabric according to claim 1, wherein weaving conditions are selected to let the woven fabric have an air permeability of not more than about 1.0 $cc/cm^2/sec$.

16. A method of making a fabric according to claim 1, wherein the warp yarns and the weft yarns are of about 100 to about 1,000 deniers respectively, and weaving conditions are selected to achieve not less than about 2,100 in the total cover factor CF of the woven fabric.

17. A method of making a fabric according to claim 16, wherein the ratio CF2/CF1 of weft cover factor to warp cover factor is in a range from 0.9 to 1.

18. A method of making a fabric according to claim 1, wherein the fabric is a base cloth for uncoated air bags.

* * * * *